US010801252B2

(12) United States Patent
Uskolovsky

(10) Patent No.: US 10,801,252 B2
(45) Date of Patent: Oct. 13, 2020

(54) WINDOW ASSEMBLY

(71) Applicant: Alexander Uskolovsky, Los Angeles, CA (US)

(72) Inventor: Alexander Uskolovsky, Los Angeles, CA (US)

( * ) Notice: Subject to any disclaimer, the term of this patent is extended or adjusted under 35 U.S.C. 154(b) by 0 days.

(21) Appl. No.: 16/313,028

(22) PCT Filed: Jun. 23, 2017

(86) PCT No.: PCT/US2017/039095
§ 371 (c)(1),
(2) Date: Dec. 22, 2018

(87) PCT Pub. No.: WO2017/223503
PCT Pub. Date: Dec. 28, 2017

(65) Prior Publication Data

US 2019/0330912 A1 Oct. 31, 2019

Related U.S. Application Data

(60) Provisional application No. 62/354,722, filed on Jun. 25, 2016.

(51) Int. Cl.

| | |
|---|---|
| ***E06B 5/00*** | (2006.01) |
| ***E06B 3/28*** | (2006.01) |
| ***E06B 3/54*** | (2006.01) |
| *E06B 7/02* | (2006.01) |

(52) U.S. Cl.
CPC ..... *E06B 3/285* (2013.01); *E06B 3/5418* (2013.01); *E06B 7/02* (2013.01)

(58) Field of Classification Search
CPC ..... E06B 3/285; E06B 3/5418; E06B 7/02
See application file for complete search history.

(56) References Cited

U.S. PATENT DOCUMENTS

| | | | | | |
|---|---|---|---|---|---|
| 2,479,819 | A | * | 8/1949 | De Ragon | E04B 2/62 52/204.1 |
| 2,602,501 | A | | 7/1952 | Roos | |
| 2,620,750 | A | * | 12/1952 | Watter | B61D 17/08 105/401 |
| 3,112,535 | A | * | 12/1963 | Kinney | E04B 1/98 52/1 |
| 3,149,436 | A | * | 9/1964 | Varlonga | E04F 13/0803 52/206 |
| 3,325,951 | A | * | 6/1967 | Johnson | E04D 13/032 52/86 |
| 4,040,210 | A | * | 8/1977 | Land | E06B 7/28 52/2.12 |
| 4,157,639 | A | * | 6/1979 | Saunders | E04D 13/03 52/222 |
| 4,173,854 | A | * | 11/1979 | Wallerstein | E04D 13/03 52/200 |
| 4,258,517 | A | | 3/1981 | Hammond | |
| 4,281,476 | A | | 8/1981 | LeVan | |

(Continued)

FOREIGN PATENT DOCUMENTS

| | | | |
|---|---|---|---|
| EP | 0677636 | A2 | 10/1995 |
| WO | 2005047633 | A1 | 5/2005 |

*Primary Examiner* — Gisele D Ford
(74) *Attorney, Agent, or Firm* — Ellie Gendloff; Gendloff IP

(57) ABSTRACT

Provided is a frameless window assembly made from a sheet with resilient edge(s).

20 Claims, 3 Drawing Sheets

(56) References Cited

U.S. PATENT DOCUMENTS

| | | | | | |
|---|---|---|---|---|---|
| 4,364,198 | A * | 12/1982 | Netti | E06B 3/28 | 49/413 |
| 4,599,825 | A * | 7/1986 | Sixsmith | E06B 3/28 | 49/466 |
| 6,009,683 | A * | 1/2000 | Grewe | E04C 3/30 | 52/301 |
| 6,052,957 | A * | 4/2000 | Minnich | E06B 3/28 | 52/202 |
| 6,385,939 | B1 * | 5/2002 | Stout | G09F 15/0025 | 52/222 |
| 6,742,565 | B2 * | 6/2004 | Badley | E06B 3/28 | 160/378 |
| 8,171,682 | B2 | 5/2012 | Pulcini et al. | | |
| 8,220,215 | B2 * | 7/2012 | Ismay | E04F 13/0871 | 52/311.1 |
| 8,272,178 | B2 * | 9/2012 | Pardue | E06B 3/28 | 49/498.1 |
| 8,490,345 | B2 | 7/2013 | Fields | | |
| 9,845,636 | B2 * | 12/2017 | Wexler | E06B 3/285 | |
| 2006/0283086 | A1 * | 12/2006 | Rittie | E06B 7/02 | 49/70 |
| 2008/0104900 | A1 | 5/2008 | Joasil | | |
| 2014/0290160 | A1 * | 10/2014 | Altieri, Jr. | E06B 7/02 | 52/203 |
| 2015/0376938 | A1 * | 12/2015 | Pardue | E06B 3/28 | 52/202 |

* cited by examiner

WINDOW ASSEMBLY

CROSS-REFERENCE TO RELATED APPLICATIONS

This application claims the benefit of U.S. Provisional Application No. 62/354,722 filed Jun. 25, 2016, and incorporated by reference herein in its entirety.

BACKGROUND OF THE INVENTION

(1) Field of the Invention

The present application generally relates to assemblies for insulating wall openings, in particular window openings.

(2) Description of the Related Art

A window assembly lets light and views from outside while insulating the interior from the ambient external environment. Window assemblies typically are in the form of a rigid frame fixed in a window opening and contain one or more unbending transparent glass panes. The assemblies are often complicated and laborious to install, and expensive.

An example of an window assembly is described in the U.S. Pat. No. 4,258,517. That window assembly is fixed to the existing window frame with a thin soft plastic membrane as a flexible pane being parallel and additional to the regular rigid glass pane. The membrane is convolutely wound around a window shaft mounted at the top of the frame. That membrane assembly utilizes a rigid window frame to which it is attached. The membrane is made of a soft plastic material like Mylar that lacks resiliency. Moreover, it is wound around a window shaft mounted at the top of the rigid frame, and it may even be damaged if bent around sharp corners.

A simple window assembly providing easy installation would be advantageous, allowing rapid temporary or permanent protection of a framed or unframed opening in a wall. The present invention addresses that need.

BRIEF SUMMARY OF THE INVENTION

The present invention is directed to a window assembly for an opening in a wall. The assembly comprises at least one sheet having at least one dimension larger than the opening. The sheet also comprises at least one resilient edge in the direction of the larger dimension so that abutting the resilient edge against the opening creates sufficient spring thrust to hold the sheet in the opening when the sheet is inserted therein.

The invention is also directed to the window assembly installed into the opening.

Additionally, the invention is directed to a method of installing the window assembly into a window opening by inserting the above window assembly into the window opening.

BRIEF DESCRIPTION OF THE SEVERAL VIEWS OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

DETAILED DESCRIPTION OF THE INVENTION

As used herein, the singular forms "a", "an" and "the" are intended to include the plural forms as well, unless the context clearly indicates otherwise. Additionally, the use of "or" is intended to include "and/or", unless the context clearly indicates otherwise.

Provided herewith is a window assembly for an opening in a wall. The assembly comprises at least one sheet having at least one dimension larger than the opening. The sheet further comprises at least one resilient edge in the direction of the larger dimension so that abutting the resilient edge against the opening creates sufficient spring thrust to hold the sheet in the opening when the sheet is inserted therein.

As further described below, this window assembly is simpler to install than other window assemblies and not subject to breakage. Other advantages include low cost, ease of fabrication, reliability and durability, sound and thermal insulation, and the opportunity for its installation by laymen, without the involvement of professionals.

Figure 1:
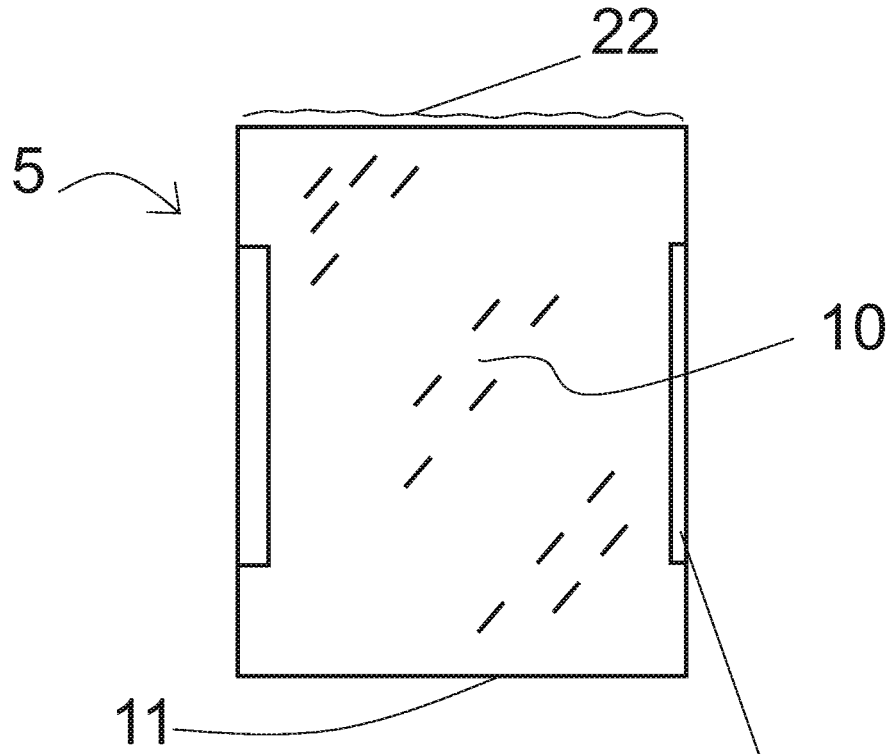
FIG. 1 is a frontal view of a window assembly of the present invention.
Figure 2:
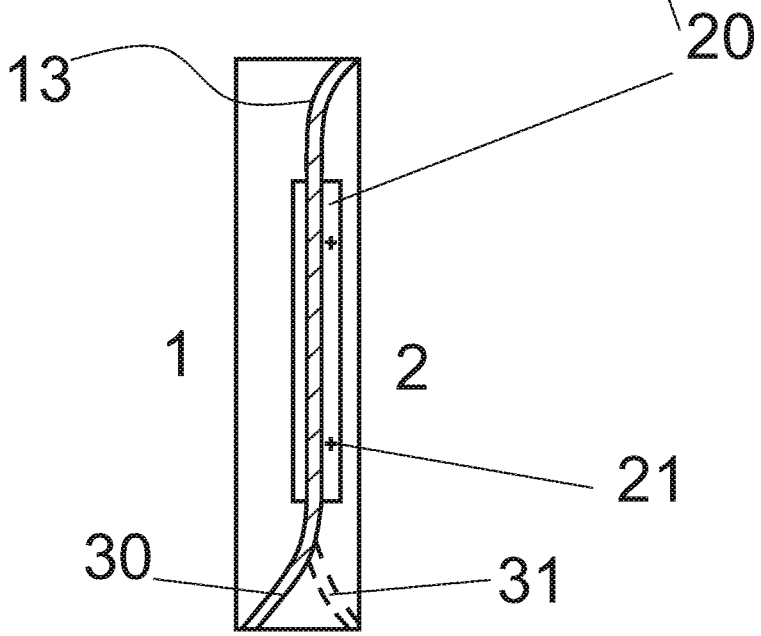
FIG. 2 is a side view of a window assembly of the present invention.

Referring now to FIGS. 1-2, a window assembly 5 is shown. The assembly can be installed into an opening in a wall. The assembly 5 comprises at least one sheet 10 having a top, a bottom, and opposing sides. The sheet further comprises a first resilient edge 11 capable of holding the sheet in the opening by generating a spring thrust when the sheet is inserted therein. The window assembly can be inserted into any opening in the wall with some having window jamb and sill and some not having window jamb and window sill.

The opening in a wall can have any shape. The window assembly 5 is simple to apply into window openings of intricate forms as well as conventional flat rectangular openings. Shapes of openings into which the invention window assembly can be installed include circular, trapezoidal, polygonal, or concave/convex forms.

The window assembly can comprise a second resilient edge 13 opposite the first resilient edge 11 to provide greater flexibility. The number of resilient edges is not limited, as the assembly can be designed to have multiple resilient edges to accommodate an opening of any shape. The spring thrust is due to the sheet's resilient edges 11, 13 fixed to and abutting against the opening walls at an angle to the sheet's plane thus exerting compressive forces and friction on the sheet. To obtain adequate spring thrust to firmly hold the sheet in the opening, the sheet must have a sufficient thickness and be made of material with an elastic modulus sufficient to ensure the sheet's longitudinal firmness while having flexibility enough to bend out its resilient edges 11, 13. In various embodiments, a single sheet does not by itself have sufficient rigidity to hold itself upright in the opening. In those embodiments, the sheet is secured in the opening with brackets and/or additional resilient edges. In some embodiments, there are four resilient edges to accommodate a rectangular opening.

The sheet can be fabricated from any suitable material, for example a polyurethane, vinyl, an aliphatic epoxy, an elastomer, a metal, polystyrene, fiberglass, or acrylonitrile butadiene styrene (ABS). In some embodiments, the material is polycarbonate.

With any material, including polycarbonate, a suitable thickness of the sheet and resilient edge depends on the size of the opening. For example, a 1-2 mm thick sheet of polycarbonate provides sufficient resiliency and rigidity to bend enough at the edge to hold the sheet in a four foot square opening, while not bending in the middle to an unacceptable degree. A larger opening can accommodate a thicker sheet. At a thickness above 5 mm, polycarbonate is not flexible enough to be able to easily bend sufficiently to install into an opening. Polycarbonate as thin as 0.5 mm can be used in the window assembly.

In some embodiments, the resilient edge is the same material as the rest of the sheet. In other embodiments, the resilient edge is a different material than the rest of the sheet.

In various embodiments, the resilient edge is thinner than the middle of the sheet. This is particularly useful with a larger window assembly, e.g., larger than about three, four or five feet square, since a sheet of uniform thickness that is thin enough for the edge to easily bend and hold the sheet in such a large opening will also bend in the middle of the opening. However, a sheet that is thicker in the middle than the edge is rigid enough in the thicker middle so that significant bending in the middle does not occur. This bending in the middle of the sheet can also be avoided by using brackets 20 holding the edges flat along the opening, and not bent outward.

Longitudinal firmness may be provided by increasing the local thickness of the sheet 10 thus reducing its flexibility beyond the resilient edge(s), for example, in the middle of its length. Additionally, to ensure the longitudinal firmness of the elongated resilient sheet 10, a number of brackets (longitudinal profiles) 20 fixed to the window walls may be used to receive and hold boundary portions of the sheet 10 beyond the resilient edge 11.

Figure 4:
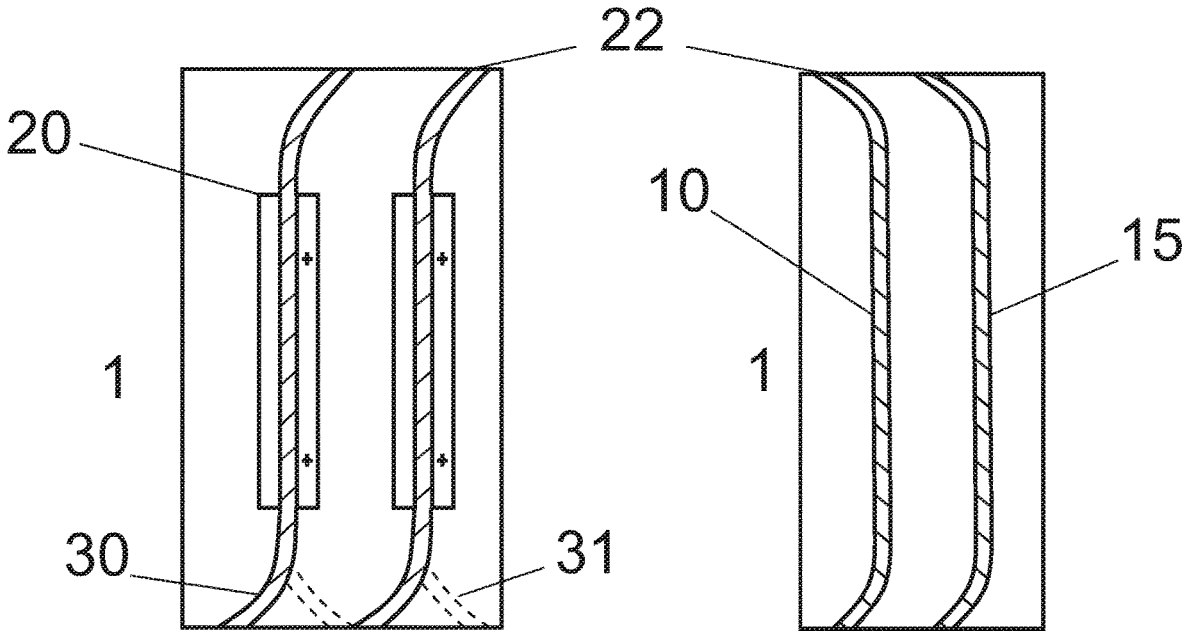
FIG. 4 is side views of a window assembly of the present invention.
Figure 5:
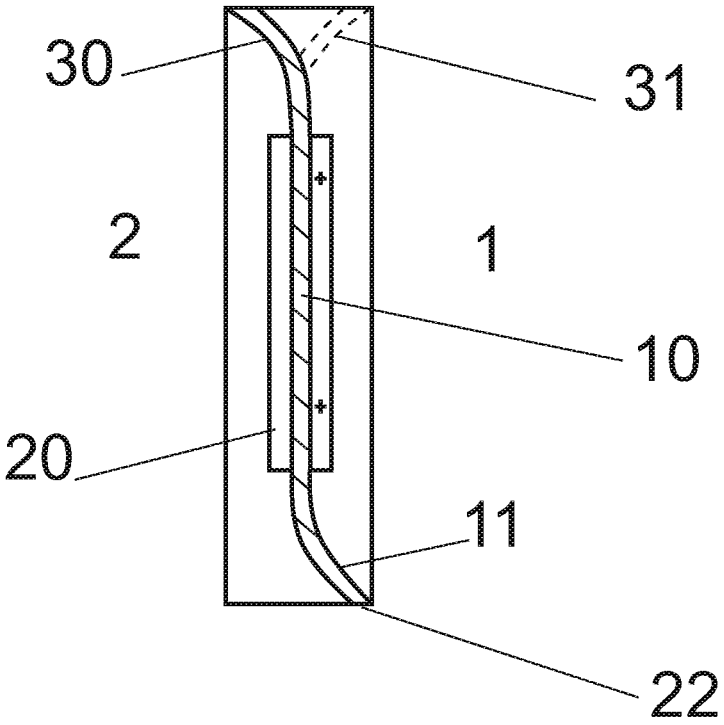
FIG. 5 is a side view of a window assembly of the present invention.

In some embodiments, for air ventilation, a through-hole can be cut out in the plastic sheet(s) 10 that is easily machined, in the through-hole a tube is fixed provided with a pivotal plane of sizes of tube's full cross-section within the tube, the plane can be rotated to positions across and along the tube axis, and any position there between, thereby controlling the air flow through the tube from 0 to 100%.

Where the window assembly comprises two resilient edges opposite each other, when installed into the opening, the two edges can be bent in mirror symmetry (in the same direction), depicted in FIGS. 2 and 4 as a "C" configuration 31. Alternatively, the two edges can be bent in rotation symmetry (in opposite directions), depicted in FIGS. 2 and 4 as a "Z" configuration 30.

The mirror symmetry 31 or rotation symmetry 30 of bending of the plastic sheet 10 in the opening allows for compensation for a high rate of thermal expansion/contraction being consistent for plastics, especially polycarbonate, due to changing the shape of the bend when the sheet 10 is expanding/reducing its length, thus effectively solving the problem of unfeasibility of rigid fixing of ends of an ordinary thermally expanding/contracting plastic sheets.

Figure 3:
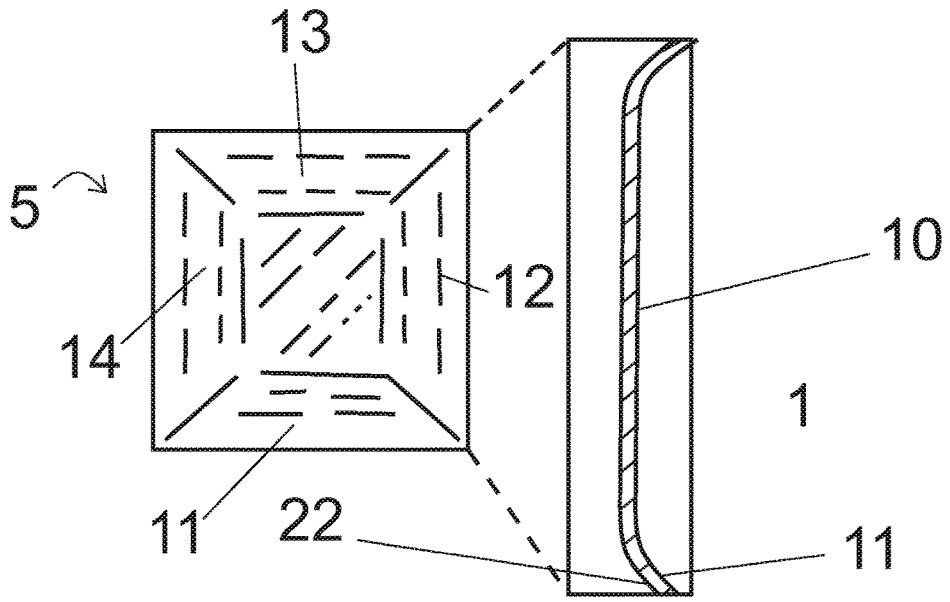
FIG. 3 is a side view (right) and a frontal view (left) of a window assembly of the present invention.

In additional embodiments, as shown in FIG. 3, the sheet comprises four resilient edges 11, 12, 13 and 14. When installed, the four resilient edges butt up against a rectangular opening walls in all four directions, i.e., against both horizontal and vertical window walls at the same time. The four resilient edges can be in mirror symmetry or in rotation symmetry to each other.

In FIGS. 1-5, where an edge of the sheet, e.g., a resilient edge 11, meets the opening wall, there may be a gap or slit. To seal the gaps between an edge and the window opening walls to provide for waterproofing, soundproofing, airtightness, and/or temperature insulation, and fixing the resilient sheet in the window opening assembly, the sealing foam 22 can be used, and/or other conventional fixing means such as screws 21 and water stops. This would insulate the interior 2 against environmental factors like water, wind, noise, temperature, and others.

The embodiment of FIG. 4 shows an optional second sheet 15 is installed parallel to the first resilient sheet 10. This further increases the insulating properties of the window assembly 5, several the parallel sheets 10, 15 can be installed in the window opening to form at least one insulating layer of air (gas) between the sheets, for example, 10 and 15. Due to its simplicity and low cost production, the window assembly 5 allows installing as many resilient plastic sheets 10 in parallel spaced relation to each other as needed and thus forming as many insulating layers of air so as it fits through the thickness of the window opening wall.

In some embodiments, the sheet is covered with a thin layer of tint, shade or reflective material, for example to become a mirror from the outside and transparent from the inside. Materials used in tint-adjusting sunglasses can also be utilized, to allow the amount of tinting to change in response to brighter or dimmer exterior.

In various embodiments, the window assembly 5 is installed by inserting the sheet 10 into a window opening. In these embodiments, the resilient edge 11 is bent and pushed with spring thrust into the opening and the other edges are placed so that the sheet covers the opening. Where two resilient edges 11, 13 are utilized, the second resilient edge 13 is bent and pushed with spring thrust in the same direction as the first resilient edge 11 to create a mirror symmetrical configuration 31, or pushed with spring thrust into the opposite direction as the first resilient edge 11 to form a rotation symmetrical configuration 30. The sheet 10 is optionally secured to the opening walls using brackets 20 on the wall of the opening. Additionally, where the sheet joins with the opening walls, an edge can be sealed and/or secured with sealing foam 22 and/or a waterstop to provide waterproofing, soundproofing, airtightness, and/or thermal insulation of the interior 2. To better protect the interior 2 from rain or snow, the resilient edge 11 may be inserted outward at the lowest section of the outward-facing side of the sheet 10.

To further protect the interior 2 from the exterior 1 environment, a second window assembly may be installed parallel to the first window assembly as depicted in FIG. 4.

These parallel sheets 10 can be deposed on in mirror symmetry 31 or rotational symmetry 30 when inserted therein. Sealing foam 22 may be subsequently applied in any or all of the edges. The multi-layered sheets can also have different configurations, respectively. For example, the edges of the sheet facing the exterior 1 can have rotational symmetry 30 with the bottom part sloping outward to prevent water from getting inside as mentioned above, while the edges of the inner sheet can have mirror symmetry 31 facing outward (i.e., out of the interior of the structure), for example to make application of sealing foam easier.

REFERENCES

U.S. Pat. No. 8,490,345

U.S. Pat. No. 8,171,682

PCT Patent Publication WO/2005/047633

In view of the above, it will be seen that several objectives of the invention are achieved and other advantages attained.

As various changes could be made in the above methods and compositions without departing from the scope of the invention, it is intended that all matter contained in the above description and shown in the accompanying drawings shall be interpreted as illustrative and not in a limiting sense.

All references cited in this specification are hereby incorporated by reference. The discussion of the references herein is intended merely to summarize the assertions made by the authors and no admission is made that any reference constitutes prior art. Applicants reserve the right to challenge the accuracy and pertinence of the cited references.

What is claimed is:

1. A window assembly for an opening in a wall, the assembly comprising at least one resilient flexible sheet of a material having at least one dimension larger than the opening, the sheet further comprising at least one resilient flexible edge, continuous with a middle part of the sheet, in the direction of the at least one dimension so that bending and abutting the resilient flexible edge against the wall creates sufficient spring thrust to restrain the resilient flexible sheet in the opening when the sheet is inserted therein such that the resilient flexible edge is bent and abutted to the wall and held in place after the insertion, wherein the edge is bent at an angle to the middle part of the sheet.

2. The assembly of claim 1, wherein the at least one resilient flexible edge is of the same material as the resilient flexible sheet.

3. The assembly of claim 1, wherein the at least one resilient flexible edge is of a different material from the sheet.

4. The assembly of claim 1, wherein the material is a plastic.

5. The assembly of claim 4, wherein the plastic is polycarbonate or acrylonitrile butadiene styrene (ABS).

6. The assembly of claim 1, wherein the resilient flexible sheet is less than 2 millimeters thick at the resilient flexible edge.

7. The assembly of claim 1, wherein a middle part of the resilient flexible sheet is thicker than the resilient edge.

8. The assembly of claim 1, further comprising a bracket.

9. The assembly of claim 1, further comprising a through-hole in the sheet, where airflow through the through-hole can be controlled.

10. The assembly of claim 9, wherein airflow through the through-hole is controlled with a pivotal plane fixed in the through-hole to control the airflow through the through-hole.

11. The assembly of claim 1, installed into the opening in a wall.

12. The assembly of claim 11, wherein the resilient flexible edge is attached to the wall.

13. The assembly of claim 11, wherein more than one resilient flexible sheet are installed in the opening.

14. A method of installing a window assembly into an opening in a wall, the method comprising inserting at least one window assembly of claim 1 into the opening by bending the resilient flexible edge of the resilient flexible sheet at an angle to the middle part of the sheet, and abutting the edge against the wall, creating sufficient spring thrust to restrain the resilient flexible sheet in the opening.

15. The method of claim 14, wherein the window assembly comprises two resilient flexible edges opposite each other and the two resilient flexible opposite edges are bent and pushed into the opening with spring thrust in mirror symmetry with each other.

16. The method of claim 14, wherein the window assembly comprises two resilient flexible edges opposite each other and the two resilient opposite edges are bent and pushed into the opening with spring thrust in rotation symmetry with each other.

17. The method of claim 14, wherein at least one bracket is installed.

18. The method of claim 14, wherein a bottom resilient flexible edge of the sheet having a side that is exposed to an exterior, wherein said edge is bent and inserted outward to the exterior.

19. The method of claim 14, further comprising installing another window assembly into the window opening in addition to the at least one window assembly.

20. The assembly of claim 1, wherein the sheet, depending on the wall opening size, has a sufficient thickness and be made of material with an elastic modulus sufficient to ensure the sheet's longitudinal firmness while having flexibility enough to bend out its resilient edges.

* * * * *